US012414668B2

(12) United States Patent
Heidel et al.

(10) Patent No.: US 12,414,668 B2
(45) Date of Patent: Sep. 16, 2025

(54) DISHWASHER, METHOD FOR OPERATING A DISHWASHER, AND COMPUTER PROGRAM PRODUCT

(71) Applicant: BSH Hausgeräte GmbH, Munich (DE)

(72) Inventors: Andreas Heidel, Holzheim (DE); Johannes Wölfle, Villenbach (DE); Vitus Hörmann, Glött (DE); Bernd Kränzle, Dischingen (DE)

(73) Assignee: BSH Hausgeräte GmbH, Munich (DE)

( * ) Notice: Subject to any disclaimer, the term of this patent is extended or adjusted under 35 U.S.C. 154(b) by 563 days.

(21) Appl. No.: 16/972,640

(22) PCT Filed: Jun. 4, 2019

(86) PCT No.: PCT/EP2019/064517
§ 371 (c)(1),
(2) Date: Dec. 7, 2020

(87) PCT Pub. No.: WO2019/234040
PCT Pub. Date: Dec. 12, 2019

(65) Prior Publication Data

US 2021/0235963 A1 Aug. 5, 2021

(30) Foreign Application Priority Data

Jun. 7, 2018 (DE) ..... 10 2018 209 076.9

(51) Int. Cl.
*A47L 15/00* (2006.01)
*A47L 15/42* (2006.01)
*A47L 15/46* (2006.01)

(52) U.S. Cl.
CPC ..... *A47L 15/4212* (2013.01); *A47L 15/0049* (2013.01); *A47L 15/4217* (2013.01);
(Continued)

(58) Field of Classification Search
CPC ..... A47L 15/4212; A47L 15/0049; A47L 15/4217; A47L 15/4223; A47L 15/4225;
(Continued)

(56) References Cited

U.S. PATENT DOCUMENTS 5,131,432 A 7/1992 Santarossa
5,803,985 A * 9/1998 Alvord ..... G05D 9/12 134/57 D
(Continued)

FOREIGN PATENT DOCUMENTS

DE 20122927 U1 4/2010
DE 102010039611 A1 2/2012
(Continued)

OTHER PUBLICATIONS

JPH07136097A Written Description (Year: 1993).*
(Continued)

*Primary Examiner* — Eric W Golightly
*Assistant Examiner* — Richard Z. Zhang
(74) *Attorney, Agent, or Firm* — Michael E. Tschupp; Andre Pallapies; Brandon G. Braun

(57) ABSTRACT

A dishwasher includes a dishwasher interior for washing items to be washed with washing liquor. Arranged at a lower end of the dishwasher interior is a pump sump for collecting the washing liquor, and a sensor is arranged in the pump sump for outputting a sensor signal as a function of a presence of washing liquor at the sensor. A control apparatus configured to carry out a washing program selected from a number of washing programs is designed to determine a malfunction of a component of a hydraulic assembly as a function of the sensor signal and of a current operating state of the dishwasher.

16 Claims, 6 Drawing Sheets

(52) U.S. Cl.
CPC ..... *A47L 15/4223* (2013.01); *A47L 15/4225* (2013.01); *A47L 15/4244* (2013.01); *A47L 15/4257* (2013.01); *A47L 15/4285* (2013.01); *A47L 15/4293* (2013.01); *A47L 15/4297* (2013.01); *A47L 15/46* (2013.01); *A47L 15/4214* (2013.01); *A47L 15/4291* (2013.01); *A47L 2401/06* (2013.01); *A47L 2401/07* (2013.01); *A47L 2401/08* (2013.01); *A47L 2401/09* (2013.01); *A47L 2401/26* (2013.01); *A47L 2401/34* (2013.01); *A47L 2501/26* (2013.01)

(58) Field of Classification Search
CPC ..... A47L 15/4244; A47L 15/4257; A47L 15/4285; A47L 15/4293; A47L 15/4297; A47L 15/46; A47L 2401/06; A47L 2401/07; A47L 2401/08; A47L 2401/09; A47L 2401/26; A47L 2401/34; A47L 2501/26; A47L 15/4214; A47L 15/4291; A47L 2501/32; A47L 15/4246; A47L 15/421
See application file for complete search history.

(56) References Cited

U.S. PATENT DOCUMENTS

| | | | | |
|---|---|---|---|---|
| 7,588,038 | B2 | 9/2009 | Jeong | |
| 9,055,850 | B2 | 6/2015 | Jerg | |
| 2003/0034052 | A1* | 2/2003 | Kiesler | A47L 15/4244 134/25.2 |
| 2004/0255977 | A1* | 12/2004 | Slocum | A47L 15/4287 134/25.2 |
| 2005/0241675 | A1* | 11/2005 | Jung | A47L 15/4244 134/25.2 |
| 2006/0005863 | A1* | 1/2006 | Gurubatham | A47L 15/4227 134/104.1 |
| 2007/0144564 | A1* | 6/2007 | Gadini | D06F 39/087 134/104.2 |
| 2007/0272286 | A1 | 11/2007 | Curtius | |
| 2010/0300487 | A1* | 12/2010 | Rolek | A47L 15/44 134/172 |
| 2011/0048460 | A1* | 3/2011 | Grull | A47L 15/0049 134/57 D |
| 2011/0273714 | A1* | 11/2011 | Pimputkar | D06F 34/22 356/442 |
| 2012/0000535 | A1 | 1/2012 | Defilippi | |
| 2012/0031432 | A1* | 2/2012 | Beaudet | A47L 15/4293 134/18 |
| 2012/0042908 | A1* | 2/2012 | Jerg | A47L 15/0013 134/18 |
| 2012/0125369 | A1 | 5/2012 | Forster | |
| 2013/0008477 | A1 | 1/2013 | Forst | |
| 2013/0133699 | A1* | 5/2013 | Brandstetter | A47L 15/0049 134/186 |
| 2014/0060579 | A1* | 3/2014 | Slabbekoorn | A47L 15/0021 134/10 |
| 2014/0158163 | A1 | 6/2014 | Burrows | |
| 2018/0132694 | A1 | 5/2018 | Thiyagarajan | |

FOREIGN PATENT DOCUMENTS

| | | | | |
|---|---|---|---|---|
| DE | 102011076831 | A1 | 12/2012 | |
| EP | 1352605 | A1 * | 10/2003 | A47L 15/0044 |
| JP | H07136097 | A * | 11/1993 | |
| KR | 20060063392 | A * | 6/2006 | |
| KR | 20110004087 | U * | 4/2011 | |
| KR | 20130059710 | A | 6/2013 | |

OTHER PUBLICATIONS

KR 20110004087 U Written Description (Year: 2011).*
International Search Report PCT/EP2019/064517 dated Sep. 11, 2019.
National search Report DE 102018209076.9 dated Mar. 12, 2019.
National Search Report CN 2019800375997 dated Oct. 7, 2023.

* cited by examiner

DISHWASHER, METHOD FOR OPERATING A DISHWASHER, AND COMPUTER PROGRAM PRODUCT

CROSS-REFERENCES TO RELATED APPLICATIONS

This application is the U.S. National Stage of International Application No. PCT/EP2019/064517, filed Jun. 4, 2019, which designated the United States and has been published as International Publication No. WO 2019/234040 A1 and which claims the priority of German Patent Application, Serial No. 10 2018 209 076.9, filed Jun. 9, 2018, pursuant to 35 U.S.C. 119(a)-(d).

BACKGROUND OF THE INVENTION

The present invention relates to a dishwasher, a method for operating a dishwasher, and a computer program product.

Conventional dishwashers, in particular household dishwashers, have a number of valves, which are opened or closed at different times while a washing program is being carried out. Error-free operation of these valves is important in order to achieve a good washing result. It can occur, for example, that soiled washing liquor which has already been pumped out of the dishwasher interior flows back into the dishwasher interior on account of a leaky outlet valve, which can result in the dishes becoming soiled again and in the formation of unpleasant odors. Furthermore, in dishwashers having a liquor reservoir, a defective outlet valve of the liquor reservoir can result in the stored fluid running out and being pumped away, as a consequence of which there is then an insufficient volume of fluid in the dishwasher interior, which could impair the washing result.

U.S. Pat. No. 7,588,038 B2 describes a design of a pump sump for a dishwasher. Because the pump sump has a plurality of components, there is an increased risk of washing fluid being lost as a result of a leak. A sensor is used, which makes it possible to determine whether the washing fluid is circulating properly. If this is not the case, the problem may be caused by a leak in the pump sump, as a result of which there is no longer sufficient washing fluid in the dishwasher.

BRIEF SUMMARY OF THE INVENTION

Against this background, an object of the present invention consists in providing an improved dishwasher.

According to a first aspect, a dishwasher, in particular a household dishwasher, with a dishwasher interior for washing items to be washed by means of a washing liquor, which items can be arranged in the dishwasher interior, a control apparatus for carrying out one of a number of washing programs, a pump sump for collecting the washing liquor, which pump sump is arranged at a lower end of the dishwasher interior, and a sensor arranged in the pump sump for outputting a sensor signal as a function of the presence of washing liquor at the sensor, is proposed. The control apparatus is designed to determine a malfunction of a component of a hydraulic assembly of the dishwasher as a function of the sensor signal and of a current operating state of the dishwasher.

This dishwasher has the advantage that, with a very simple design, a plurality of malfunctions or faults can be determined in components which are important for the operation of the dishwasher, in particular also for a good washing result. The determination of the malfunctions as a function of the operating state of the dishwasher enables the assignment of the malfunction to a specific component. In particular, the sensor can then perform a double function: the sensor signal can be used on the one hand to determine the malfunction, and on the other hand to determine a soiling of the washing liquor while a washing program is being carried out. The proposed dishwasher has increased reliability and offers the possibility to detect malfunctions reliably and unambiguously so that, once detected, a malfunction can be eliminated with minimal effort.

The control apparatus is embodied in particular as the central control unit which controls and actuates all functional components or elements of the dishwasher. The control apparatus can be implemented as hardware and/or software. If implemented as hardware, the control apparatus can be embodied for example as a computer or microprocessor. If implemented as software, the control apparatus can be embodied as a computer program product, as a function, as a routine, as part of a program code or as an executable object.

For example, the control apparatus has a memory, in which the number of washing programs is stored. A washing program has for example different program sub-steps, in particular a pre-rinsing, a cleaning, a rinsing and/or a drying. During the execution of a washing program, these program sub-steps are processed in the respective sequence set by the washing program and at the time intervals predetermined by the washing program. A program sub-step is composed in particular of a number of different actions, such as for example an opening of an inlet valve for supplying fresh water, an activation of a recirculating pump, an activation of a heater and/or an activation of a drain pump for pumping washing liquor away.

The current operating state of the dishwasher depends in particular on the current program sub-step and the action last performed or started. Accordingly, the current operating state preferably comprises all current operating parameters of the dishwasher, such as for example a current volume of washing liquor, a current recirculating pump speed, a current washing liquor temperature and the like.

Washing liquor is understood to mean in particular fresh water mixed with detergent, but can also refer to any other fluid present in the dishwasher interior. The terms water, fresh water, washing liquor, soiled washing liquor or also fluid are accordingly interchangeable.

The pump sump is arranged at the lower end of the dishwasher interior. Provided that the dishwasher is installed properly, a fluid, in particular the washing liquor, will collect in the pump sump. In particular, a recirculating pump and a drain pump are arranged in the pump sump. The pump sump further has for example a filter arrangement in order to trap coarse impurities.

The sensor for outputting the sensor signal is arranged for example on the side of the pump sump. The sensor comprises in particular an optical sensor. The sensor signal output by the sensor changes as a function of the fluid surrounding the sensor, for example washing liquor or air, so that it is possible to determine as a function of the sensor signal whether the sensor is currently surrounded by washing liquor or by air. For example, a soiling of the washing liquor can be determined as a function of the sensor signal.

The control apparatus is designed to determine a malfunction of a component of a hydraulic assembly of the dishwasher as a function of the current operating state of the dishwasher and of the sensor signal. A hydraulic assembly is understood here to mean any assembly, in particular valves and/or pipes, through which water or washing liquor is guided. For example, a connection facility can be provided which has an inlet valve as well as a flow-through sensor, for example a flowmeter. This exemplary connection facility has two components and forms for example a hydraulic assembly. The malfunction of a component can also be described in the following as a malfunction of the hydraulic assembly.

According to one embodiment of the dishwasher, an inlet valve is provided for connecting the dishwasher to an external water supply pipe for supplying fresh water, wherein the current operating state comprises the supply of fresh water and the control apparatus is designed to determine a malfunction of the supply of fresh water via the inlet valve as a function of the sensor signal.

The inlet valve for connection to the external water supply pipe forms for example the hydraulic assembly. For example, it is provided that fresh water is supplied at the start of a washing program. The control apparatus then actuates the inlet valve accordingly, so that this opens. If water now flows into the dishwasher interior, the sensor signal will change accordingly after a certain time and indicate that the sensor is surrounded by water. If this is not the case, it can be concluded that either the inlet valve is not connected properly to the external water supply or that the inlet valve itself is defective and does not open, for example.

The time interval between the inlet valve opening and the sensor signal changing, provided that fresh water is supplied, depends on various factors. For example, the volume per time unit depends on the pressure in the external water supply network and the size of the inlet valve. In Germany, a pressure of 1-4 bar is assumed here, wherein for example 2-3 liters of water are supplied per minute. The volume of the pump sump and the arrangement of the sensor in the pump sump also play a role. For example, it takes 0.5 liters of water to submerge the sensor in water. Depending on these factors, it is possible for example to set a certain time interval within which the sensor signal is to change after the inlet valve has been actuated to open. If water is supplied at a rate of 2.5 liters per minute and the required water volume is 0.5 liters, the time interval amounts to 12 seconds. If the sensor signal has not changed after expiration of the time interval, the control apparatus identifies the malfunction.

According to a further embodiment of the dishwasher, a flow-through sensor is arranged between the inlet valve and the dishwasher interior to detect the fresh water volume supplied via the inlet valve, wherein the control apparatus is designed to detect a malfunction of the sensor, of the through-flow sensor and/or of the inlet valve as a function of the fresh water volume detected by the through-flow sensor and of the sensor signal.

In this embodiment, it is also advantageously possible to check whether the through-flow sensor or the sensor has a defect. In this embodiment, the inlet valve forms a hydraulic assembly with the through-flow sensor and the sensor. A distinction can be made between the following four scenarios, for example. If all components are operating normally, the through-flow sensor will measure the supplied volume of fresh water once the inlet valve has opened and, after the defined time interval, the sensor signal will change and thus indicate that the sensor is surrounded by water. If the inlet valve has a malfunction or is not connected properly to the external water supply pipe such that no or very little water is supplied, the through-flow sensor will measure that no water is being supplied and also the sensor signal will not have changed after the time interval. If the through-flow sensor has a malfunction, this will measure that no water is being supplied but the sensor signal will change within the time interval, so that the malfunction of the through-flow sensor is recognized unambiguously. If the sensor in the pump sump has a malfunction, the through-flow sensor will measure the supplied water volume but the sensor signal will not change within the time interval, so that the malfunction can be attributed unambiguously to the sensor.

In particular if the flow-through sensor is defective, this embodiment has the advantage that it is not necessary, as is customary in the prior art, to activate the drain pump and monitor its power consumption in order to determine whether fresh water is entering the dishwasher interior. This results both in reduced noise emission in this situation and in a longer service life of the recirculating pump. Furthermore, a smaller water volume is needed to detect that fresh water is entering the dishwasher interior than is the case for detection by means of the drain pump.

Provided that the flow-through sensor measures the supplied water volume, the water volume received by the pump sump until the sensor is surrounded by water can also be used instead of the time interval.

The flow-through sensor can also be arranged in front of the inlet valve or the inlet valve and the through-flow sensor form a structural unit.

In embodiments it can further be provided that, in the first scenario in which neither the through-flow sensor measures something nor the sensor signal changes within the time interval, the recirculating pump is activated and the pump flow is evaluated in order to determine whether or not water is present in the dishwasher interior. Should it be thereby detected that water is present, a malfunction of both sensors can be concluded.

According to a further embodiment of the dishwasher, a drain pump is arranged in the pump sump for pumping washing liquor out of the pump sump into an outlet hose, wherein a drain check valve is arranged between the drain pump and the outlet hose to retain the washing liquor pumped into the outlet hose, wherein the current operating state comprises pumping away the washing liquor and the control apparatus is designed to detect a leak in the drain check valve as a function of the sensor signal.

In this embodiment, the drain check valve can be regarded as the hydraulic assembly. The leakiness of the drain check valve can be designated as the malfunction. If the drain check valve is working correctly, the washing liquor can pass through it in only one direction, namely from the drain pump into the outlet hose.

For example, the outlet hose is connected to a wastewater pipe at a height of approximately 80 cm. As a result, the washing liquor which has been pumped out accumulates in the outlet hose up to this height. As soon as the drain pump is deactivated, no more washing liquor is pumped into the outlet hose, so that a certain static pressure is exerted on the drain check valve on account of the water column in the pipe. If the drain check valve is leaky, the washing liquor will flow back into the pump sump on account of this pressure. This causes the washing liquor present in the dishwasher interior to become soiled, as a result of which the cleaning of the items to be washed can no longer be reliable. On the other hand, unpleasant odors can also develop if the soiled washing liquor remains in the pump sump for a long time. If the soiled washing liquor now flows back through the leaky drain check valve, the sensor signal will change as soon as the sensor is surrounded by the soiled washing liquor. Once the washing liquor has been pumped away, a certain time interval is allowed to elapse, for example, in order to establish whether the signal changes. If this is the case, a leaky drain check valve can be concluded.

According to a further embodiment of the dishwasher, the control apparatus is designed to detect the leakiness of the drain check valve after the washing liquor has been pumped out and before fresh water is pumped into the dishwasher interior.

In this way, it is possible to avoid a false detection of the malfunction, triggered by the supply of fresh water.

According to a further embodiment of the dishwasher, a liquor reservoir is provided for the temporary storage of washing liquor, wherein a valve is arranged between the liquor reservoir and the dishwasher interior, which valve in a closed state retains the temporarily stored washing liquor in the liquor reservoir and in an open state releases the temporarily stored liquor into the dishwasher interior, wherein the current operating state comprises filling the liquor reservoir with washing liquor and retaining the washing liquor in the liquor reservoir and the control apparatus is designed to detect a leakiness of the valve as a function of the sensor signal.

In this exemplary embodiment, the valve of the liquor reservoir forms the hydraulic assembly, for example, and a leakiness of the valve is a malfunction. The liquor reservoir serves for example to store washing liquor, which has been used for rinsing at the end of a washing program and is for example only very lightly soiled, for the next washing cycle, wherein the temporarily stored washing liquor can be used in particular for pre-rinsing. In this way, water can be saved. If the valve of the liquor reservoir is leaky, then the stored washing liquor flows into the dishwasher interior between two washing cycles. It is now possible to detect by means of the sensor signal if fluid accumulates unexpectedly in the pump sump between two washing cycles, thus indicating a leaky valve. For example, the sensor signal is detected and evaluated at certain time intervals for this purpose, even when the dishwasher is switched off. Here, the current operating state indicates whether or not the liquor reservoir has been filled.

Because at the start of a washing cycle for example the drain pump is activated in order to pump fluid out of the pump sump, a leaky valve would cause the temporarily stored washing liquor to be pumped out, leaving insufficient washing liquor available for subsequent pre-rinsing. Once the leaky valve has been detected, fresh water can then be supplied in order to ensure that the dishwasher is working properly.

According to a further embodiment of the dishwasher, the control apparatus is designed to detect the leakiness of the valve after the liquor reservoir has been filled and before the temporarily stored washing liquor is released and/or fresh water is supplied into the dishwasher interior.

In this way, it is possible to avoid a false detection of the malfunction, triggered by the supply of fresh water.

According to a further embodiment of the dishwasher, a heat exchanger is provided for receiving fresh water to support a drying process and for heating the received fresh water, wherein a further valve is arranged between the heat exchanger and the dishwasher interior, which valve in a closed state retains the fresh water in the heat exchanger and in an open state releases the fresh water into the dishwasher interior, wherein the current operating state comprises filling the heat exchanger with fresh water and retaining the fresh water in the heat exchanger and the control apparatus is designed to detect a leakiness of the further valve as a function of the sensor signal.

In this exemplary embodiment, the further valve forms the hydraulic assembly and the leakiness of the further valve is a malfunction. By fresh water being supplied in the drying step to the heat exchanger, which is in thermal contact with the dishwasher interior, a condensation of moisture from the air in the dishwasher interior is facilitated on the walls of the dishwasher interior, thus promoting the drying of the items to be washed. Furthermore, the fresh water is heated. The heated fresh water can be used in particular in a subsequent washing cycle, which helps to save energy. The mode of operation for determining the leakiness is as already described for the valve of the liquor reservoir. The determination takes place in particular between two washing cycles.

According to a further embodiment of the dishwasher, the control apparatus is designed to detect the leakiness of the further valve after the heat exchanger has been filled and before the received fresh water is released and/or fresh water is supplied into the dishwasher interior.

In this way, it is possible to avoid a false detection of the malfunction, triggered by the supply of fresh water.

According to a further embodiment of the dishwasher, the dishwasher has a loading opening, which can be closed with a door, for loading the dishwasher interior with the items to be washed, wherein the door is mounted such that it can be pivoted from a closed position into an open position, wherein a door opening sensor is provided for outputting a door opening signal as a function of a current door position, wherein the current operating state comprises loading the dishwasher interior with items to be washed and the control apparatus is designed to detect a supply of fluid through the loading opening as a function of the door opening signal and the sensor signal.

In this embodiment, it is advantageously possible to detect whether fluid has been supplied during the loading of the dishwasher interior with items to be washed. It can for example occur that a user of the dishwasher places a vessel which is still partially filled with water or another fluid into the dishwasher. The fluid will then accumulate in the pump sump, which can result in the sensor being surrounded by the fluid. If the determination of a malfunction of the valve of the liquor reservoir or of the heat exchanger is now carried out after the dishwasher has been loaded, this can result in a misdiagnosis if the fluid has entered the dishwasher interior not on account of a leaky valve but during loading into the dishwasher interior. Such a misdiagnosis can advantageously be avoided by the sensor signal being detected and evaluated before and after the loading of the dishwasher interior.

According to a further embodiment of the dishwasher, the sensor is arranged in such a way in the pump sump and the pump sump is embodied in such a way that the sensor is surrounded by washing liquor with a washing liquor volume of 0.4 liters, preferably 0.3 liters, more preferably below 0.3 liters in the pump sump.

The lower the minimum volume of washing liquor or fluid required to fill the pump sump to the extent that the sensor is surrounded by the washing liquor or fluid, the lower the detectable volumes of fluid leaving or entering. In this way, a malfunction of a component of a hydraulic assembly can then be detected more quickly and more precisely.

According to a further embodiment of the dishwasher, a user interface is provided which is designed to output a detected malfunction.

The user interface comprises in particular a display on the dishwasher and/or a communication unit, for example a modem and/or a network adapter. Should a malfunction be detected, then this can be indicated for example on the display. Furthermore, a corresponding message can be transmitted for example to a mobile device of the user of the dishwasher, which mobile device is connected to the communication unit, and/or to a server of the manufacturer or of a customer service. In this way, the detected malfunction can be rectified quickly and professionally in a user-friendly manner. Because the malfunction enables an exact determination of the component which is defective or is not working properly, any spare parts which may be required to rectify the malfunction are known for example to the customer service and can be ordered if necessary. This also makes it possible to avoid two customer service appointments being required: one appointment to diagnose the fault and a second appointment to rectify the fault. Overall, this significantly increases user-friendliness and also enables a more efficient use of the dishwasher.

According to a further embodiment of the dishwasher, a memory unit is provided which is designed to store a determined malfunction, wherein the user interface is designed to output the stored malfunction.

It can occur that a malfunction initially has no serious impact on the washing results, so that the user of the dishwasher may refrain from contacting the customer service to have the malfunction rectified. If for example the valve of the liquor reservoir is leaky, this results in an increased water consumption of the dishwasher but the washing results remain uniformly good. If a service is required at a later time for another reason, then the malfunction stored in the memory unit can be read out via the user interface or output by the same, so that this malfunction too can be rectified without a separate customer service visit.

According to a further aspect, a method for operating a dishwasher, in particular a household dishwasher, is proposed. The household dishwasher comprises a dishwasher interior for washing items to be washed by means of a washing liquor, which items can be arranged in the dishwasher interior, a control apparatus for carrying out one of a number of washing programs, a pump sump for collecting the washing liquor, which pump sump is arranged at a lower end of the dishwasher interior, and a sensor arranged in the pump sump for outputting a sensor signal as a function of the presence of washing liquor at the sensor. In a first method step, a current operating state of the dishwasher is determined. This takes place in particular by means of the control apparatus. In a second method step, the sensor signal is detected and output to the control apparatus. In a third method step, a malfunction of a hydraulic assembly of the dishwasher is determined as a function of the current operating state and of the sensor signal.

The proposed method is suitable in particular for use with the dishwasher or one of the embodiments of the dishwasher according to the first aspect.

The embodiments and features described for the proposed dishwasher apply correspondingly to the proposed method.

Furthermore, a computer program product is proposed which initiates the execution of the proposed method on a program-controlled facility.

A computer program product, such as a computer program means, can for example be provided or supplied as a storage medium such as a memory card, USB stick, CD-ROM or DVD or also in the form of a file which can be downloaded from a server in a network. This can take place, for example, in a wireless communications network through the transmission of a corresponding file with the computer program product or the computer program means.

Further possible implementations of the invention also comprise combinations—not explicitly cited—of features or embodiments described above or below in respect of the exemplary embodiments. In this context, the person skilled in the art will also add individual aspects as improvements or enhancements to the respective basic form of the invention.

BRIEF DESCRIPTION OF THE DRAWINGS

Further advantageous embodiments and aspects of the invention form the subject matter of the subclaims and of the exemplary embodiments of the invention that are described below. The invention is described below in greater detail on the basis of preferred embodiments with reference to the attached figures.

DETAILED DESCRIPTION OF EXEMPLARY EMBODIMENTS OF THE PRESENT INVENTION

Figure 1:
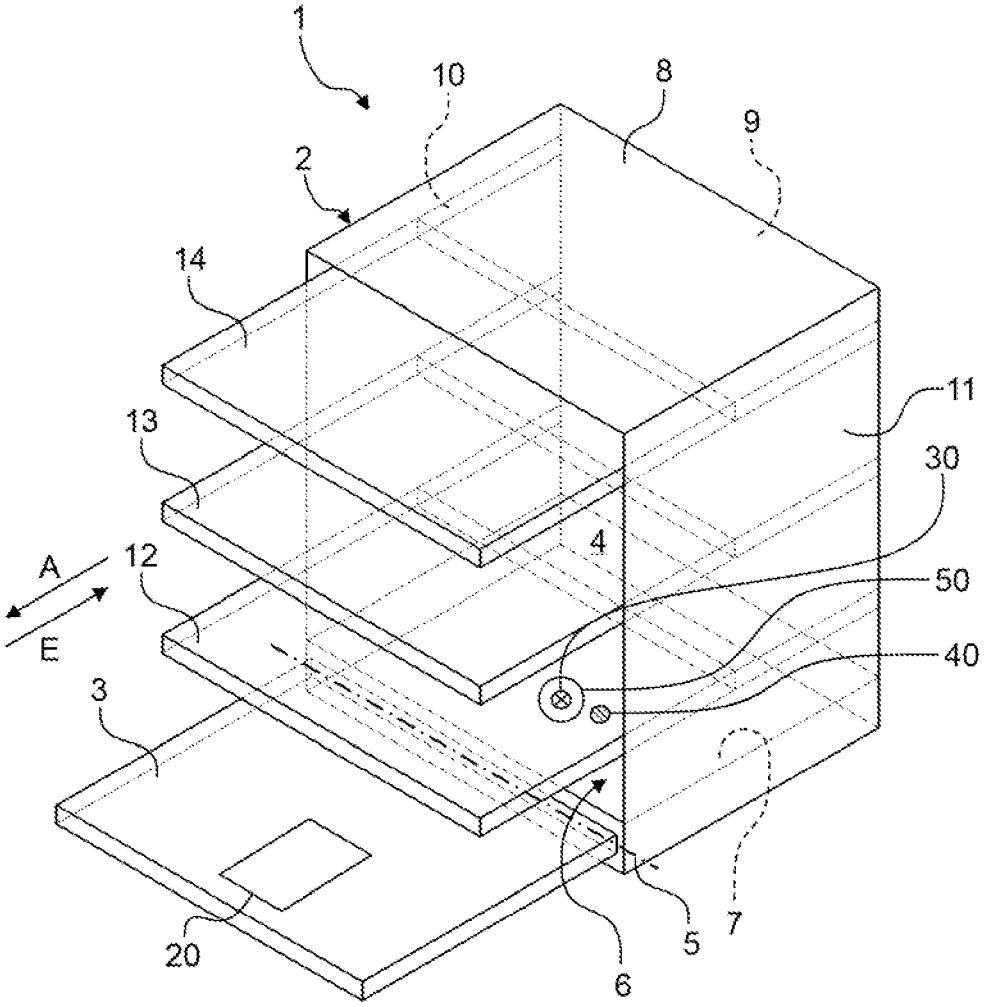
FIG. 1 shows a schematic perspective view of an exemplary embodiment of a dishwasher.

In the figures, elements that are identical or have the same function are provided with the same reference characters unless otherwise stated.

FIG. 1 shows a schematic perspective view of an embodiment of a dishwasher 1, which is embodied here as a household dishwasher. The household dishwasher 1 has a dishwasher cavity 2, which can be closed by a door 3, in particular in a watertight manner. A sealing facility can be provided for this purpose between the door 3 and the dishwasher cavity 2. The dishwasher cavity 2 is preferably cuboid in shape. The dishwasher cavity 2 may be arranged in a housing of the household dishwasher 1. The dishwasher cavity 2 and the door 3 may form a dishwasher interior 4 for washing items to be washed.

The door 3 is shown in its opened position in FIG. 1. The door 3 can be closed or opened by pivoting about a pivot axis 5 provided on a lower end of the door 3. A loading opening 6 of the dishwasher cavity 2 can be closed or opened with the aid of the door 3. The dishwasher cavity 2 has a bottom 7, a ceiling 8 arranged opposite the bottom 7, a rear wall 9 arranged opposite the closed door 3 and two side walls 10, 11 arranged opposite one another. The bottom 7, the ceiling 8, the rear wall 9 and the side walls 10, 11 may be manufactured from a stainless steel sheet for example. Alternatively, the bottom 7 may be manufactured from a plastic material.

Furthermore, the household dishwasher 1 has at least one receptacle for items to be washed 12 to 14. A number of, for instance three, receptacles for items to be washed 12 to 14 can preferably be provided, wherein the receptacle for items to be washed 12 can be a lower receptacle for items to be washed or a bottom basket, the receptacle for items to be washed 13 can be an upper receptacle for items to be washed or an upper basket and the receptacle for items to be washed 14 can be a cutlery drawer. As additionally shown in FIG. 1, the receptacles for items to be washed 12 to 14 are arranged above one another in the dishwasher cavity 2. Each receptacle for items to be washed 12 to 14 is optionally able to be shifted into or out from the dishwasher cavity 2. In particular, each receptacle for items to be washed 12 to 14 is able be inserted or pushed into the dishwasher cavity 2 in an insertion direction E and extracted or pulled out from the dishwasher cavity 2 in an extraction direction A opposite to the insertion direction E.

A control apparatus 20 is arranged on the door 3 of the dishwasher 1, which control apparatus is here implemented as hardware, for example, and is designed to carry out one of a number of washing programs. Furthermore, a pump sump 50 is arranged at the lower end of the dishwasher interior 4, in which pump sump a sensor 40 and a hydraulic assembly 30 are arranged. The sensor 40 is designed to output a sensor signal 102 (see FIGS. 5-7), which indicates which fluid is currently surrounding the sensor 40, such as for example air or washing liquor. In embodiments, the sensor 40 can also be designed to determine a degree of soiling of the washing liquor. In this example, the hydraulic assembly 30 comprises for example a drain check valve 36 (see FIG. 3), which is arranged between a drain pump and an outlet hose 70.

The control apparatus 20 is also designed to detect or determine a current operating state of the household dishwasher 1. The current operating state of the household dishwasher 1 depends in particular on a currently running program sub-step of the washing program being carried out and the action last performed or started. Accordingly, the current operating state comprises all current operating parameters of the household dishwasher 1, such as for example a current volume of washing liquor, a current recirculating pump speed, a current washing liquor temperature and the like.

The control apparatus 20 is designed in particular to determine a malfunction of the hydraulic assembly 30 as a function of the current operating state and of the sensor signal 102. Specific exemplary embodiments hereto are explained with reference to the figures described below.

Figure 2:
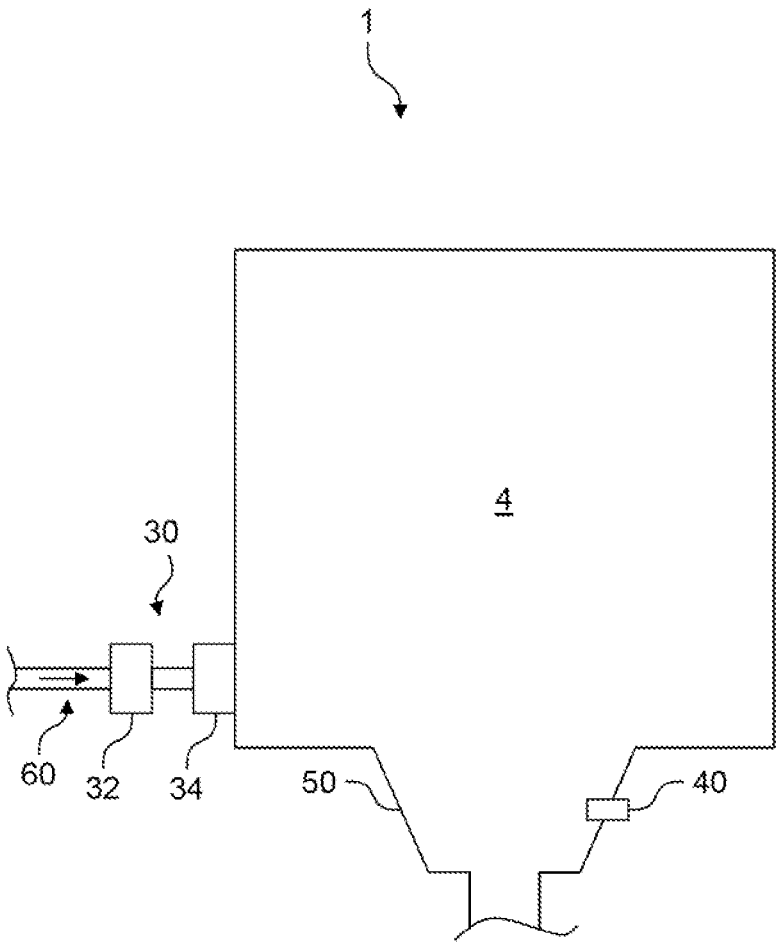
FIG. 2 shows a schematic view of a second embodiment of a dishwasher.

FIG. 2 shows a schematic view of a second embodiment of a dishwasher 1, which is embodied as a household dishwasher and in particular has all components as described for the household dishwasher from FIG. 1, even if these are not shown in FIG. 2. The household dishwasher 1 is shown in FIG. 2 in a schematic side view. The pump sump 50 is arranged at the lower end of the dishwasher cavity 4, on the side of which pump sump the sensor 40 is arranged. The pump sump 50 can furthermore have different filter assemblies, which are not shown in FIG. 2 for the sake of clarity. The hydraulic assembly 30, which here comprises a water connection with an inlet valve 32 and a flow-through sensor 34, is shown to the side of the dishwasher interior 4. The flow-through sensor 34 is designed to measure the supplied volume of fresh water. The inlet valve 32 is connected to an external water supply pipe 60. The arrow in the water supply pipe 60 indicates the flow direction of the water when the inlet valve 32 is open.

With the household dishwasher 1, it is advantageously possible to determine whether the hydraulic assembly 30, in particular the inlet valve 32 or the flow-through sensor 34 or also the sensor 40 has a malfunction or a defect.

Figure 5:
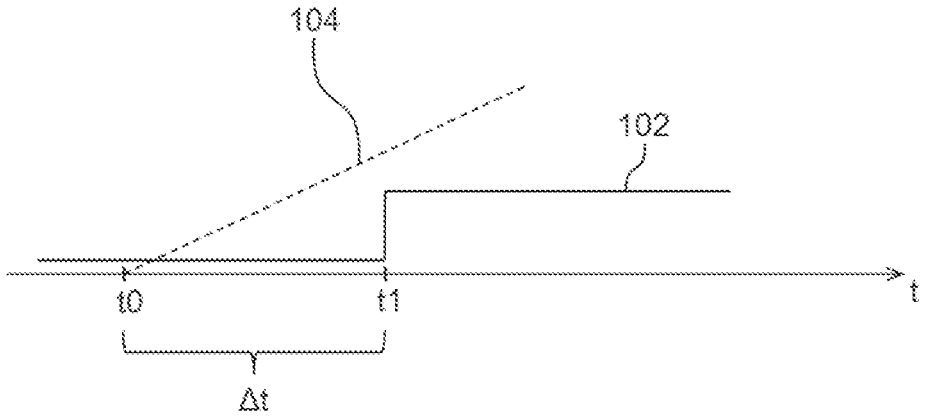
FIG. 5 shows an exemplary diagram of a sequence of sensor signals.

According to a first scenario, all components operate as intended. Once the inlet valve 32 has opened, the flow-through sensor 34 measures the supplied volume of fresh water, which is indicated by a rising sensor signal 104 (see FIG. 5). The flow-through sensor 34 is embodied for example as a flowmeter, which emits a pulse for each 5 ml of fluid that passes through the flowmeter. After a defined time interval Δt (see FIG. 5, 6), if the required volume of fresh water has been supplied, the pump sump 50 will be filled with the supplied fresh water to such an extent that the sensor 40 is now surrounded by the fresh water. The sensor signal 102 changes accordingly, wherefrom it can be concluded that the sensor 40 is surrounded by water. FIG. 5 shows an exemplary temporal sequence of the sensor signal 102 of the sensor 40 and of the sensor signal 104 of the flow-through sensor 34, as they can occur in this scenario.

According to a second scenario, the inlet valve 32 has a malfunction or the household dishwasher 1 is not properly connected to the external water supply pipe 60, so that no or very little fresh water can be supplied. Once the control apparatus 20 has actuated the inlet valve 32 to open, the flow-through sensor 34 will not measure any water flow. In addition, the sensor signal 102 will not have changed after the defined time interval Δt. It is therefore possible to conclude that no fresh water is being supplied and there is therefore a problem with the inlet valve 32 or the connection to the water supply pipe 60.

Figure 6:
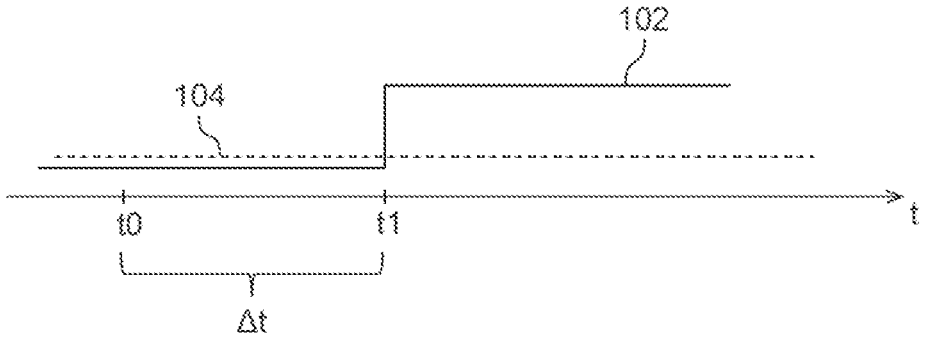
FIG. 6 shows a further exemplary diagram of a sequence of sensor signals.

According to a third scenario, the flow-through sensor 34 has a malfunction. For example, the flow-through sensor 34 outputs no measurement signal at all or it outputs an incorrect measurement signal. This can be caused, for example, by a defect or blockage of the flow-through sensor 34. Once the inlet valve 32 has opened, for example no measurement signal of the flow-through sensor 34 is detected, which indicates that no fresh water is being supplied. If however the sensor signal 102 changes its level after the defined time interval Δt, it is possible to conclude from this situation that the flow-through sensor 34 has a malfunction. FIG. 6 shows an exemplary temporal sequence of the sensor signal 102 of the sensor 40 and of the sensor signal 104 of the flow-through sensor 34, as they can occur in this scenario.

According to a fourth scenario, the sensor 40 in the pump sump 50 has a malfunction. Once the inlet valve 32 has opened, the flow-through sensor 34 will output the expected measurement signal, which indicates that fresh water is being supplied properly. However, the sensor signal 102 will not change even once the required volume of fresh water has been supplied, as the sensor 40 is defective. The defective sensor 40 can therefore be determined unambiguously.

Figure 3:
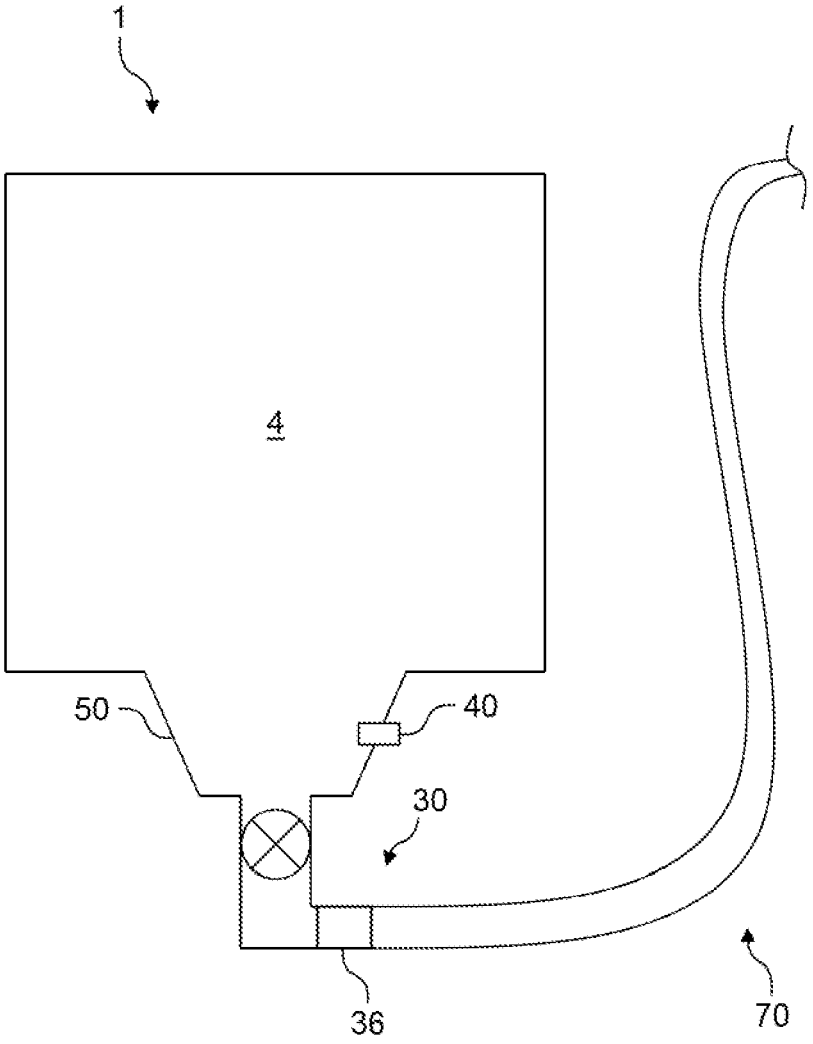
FIG. 3 shows a schematic view of a third embodiment of a dishwasher.

FIG. 3 shows a schematic view of a third embodiment of a dishwasher 1, which is embodied as a household dishwasher and in particular has all components as described for the household dishwasher from FIGS. 1 and 2, even if these are not shown in FIG. 3. The household dishwasher 1 is shown in FIG. 3 in a schematic side view. The pump sump 50 is arranged at the lower end of the dishwasher interior 4, on the side of which pump sump the sensor 40 is arranged. A drain pump (without a reference character) is arranged at the lower end of the pump sump 50, which drain pump is designed to pump the washing liquor out of the pump sump 50 into the outlet hose 70, which is connected to the pump sump 50. A drain check valve 36 is disposed between the drain pump and the outlet hose 70, which drain check valve is designed to allow the pumped-out washing liquor to flow into the outlet hose 70 but not to allow the washing liquor present in the outlet hose 70 to flow back into the pump sump 50 and thus into the dishwasher interior 4. The outlet hose 70 is in turn connected to a wastewater pipe, which is disposed for example at a height of approximately 80 cm above the connection to the pump sump 50 (not shown).

Figure 7:
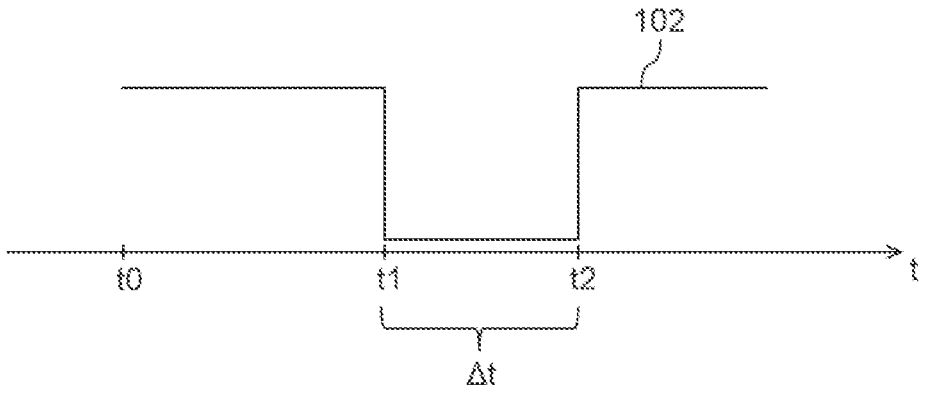
FIG. 7 shows a further exemplary diagram of a sequence of sensor signals.

If, once the soiled washing liquor has been pumped away, for example after cleaning, the drain check valve 36 has a malfunction because for example food residue has become trapped therein and is preventing the drain check valve 36 from closing tightly, some of the washing liquor will flow from the outlet hose 70 back into the pump sump 50. After a defined time interval Δt (see FIG. 7), the pump sump 50 will have filled up to such an extent that the sensor 40 is once again surrounded by the soiled washing liquor. This can be determined on the basis of the sensor signal 102 output by the sensor 40. FIG. 7 shows an exemplary temporal sequence of the sensor signal 102 of the sensor 40, as it could occur in this scenario. In this way, therefore, a malfunction of the drain check valve 36 can be concluded and detrimental effects, such as a poor washing result or the formation of unpleasant odors, can be avoided.

Figure 4:
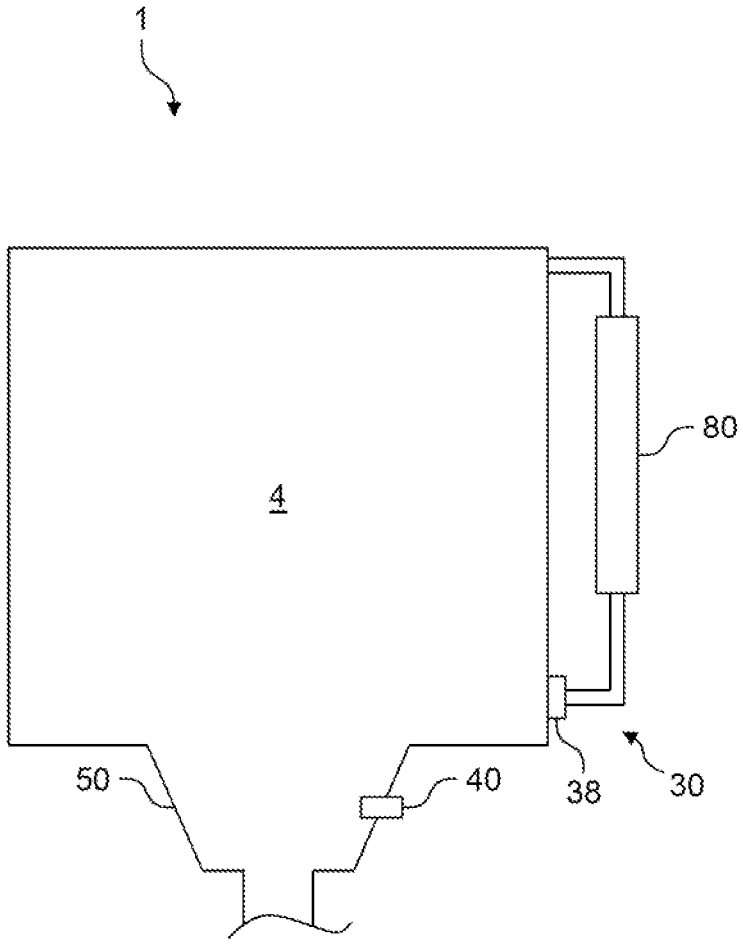
FIG. 4 shows a schematic view of a fourth embodiment of a dishwasher.

FIG. 4 shows a schematic view of a fourth embodiment of a dishwasher 1, which is embodied as a household dishwasher and in particular has all components as described for the household dishwasher from FIG. 1, even if these are not shown in FIG. 4. The household dishwasher 1 is shown in FIG. 4 in a schematic side view. The pump sump 50 is arranged at the lower end of the dishwasher interior 4, on the side of which pump sump the sensor 40 is arranged. A liquor reservoir 80 is arranged on the side of the household dishwasher 1, which liquor reservoir is connected to the dishwasher interior 4 by way of two connecting pipes (without a reference character). A valve 38, with which the content of the liquor reservoir 80 can be released into the dishwasher interior 4, is disposed on the lower supply pipe. Not shown is a recirculating pump, which serves to fill the liquor reservoir 80 with washing liquor by pumping the washing liquor into the liquor reservoir 80.

The liquor reservoir 80 is used for the temporary storage of washing liquor so that this can be used at a later time, in particular in a subsequent washing cycle. The valve 38 retains the washing liquor in the liquor reservoir 80. If however the valve 80 is leaky, then the content of the liquor reservoir 80 will run out even though the valve 38 is deemed closed. Accordingly, the content of the liquor reservoir 80 is no longer available at the later time when the temporarily stored washing liquor is to be used. If the washing liquor which has run out has in the meantime been pumped away, for example at the start of the next washing cycle, insufficient washing liquor is therefore present in the dishwasher interior 4 to ensure a good washing result. By the sensor signal 102 (see FIGS. 5-7) being evaluated at regular intervals while the washing liquor is stored in the liquor reservoir 80, it is possible to determine whether the valve 38 is leaky if the pump sump 50 is filled with washing liquor despite the valve 38 being closed.

In a further exemplary embodiment (not shown), a heat exchanger can be provided instead of the liquor reservoir 80, which heat exchanger is connected to the household dishwasher 1 in the same way as the liquor reservoir 80 but is in thermal contact with the dishwasher interior 4, so that an effect which supports drying can be achieved by introducing cold fresh water into the heat exchanger. In accordance with the aforementioned example, a further valve, which is designed to retain the fresh water in the heat exchanger, can be checked for a malfunction, in particular a leak.

FIGS. 5 and 6 in each case show an exemplary diagram of a sequence of sensor signals 102, 104 of a flow-through sensor 34 (see FIG. 2) and of a sensor 40 of a household dishwasher 1, for example the household dishwasher 1 from FIG. 2. The sensor signals 102, 104 change along a time axis t as a function of the current operating state of the household dishwasher 1. At a time instant t0, the inlet valve 32 of the household dishwasher 1 is opened, so that fresh water is supplied. In FIG. 5, the sensor signal 104 of the flow-through sensor 34 thereupon rises linearly. Once a certain volume of fresh water, for example 0.3 liters, has been supplied within the time interval Δt, the sensor signal 102 of the sensor 40 changes at a time instant t1. This indicates that the sensor 40 is now surrounded by water. The flow-through sensor 34 and the sensor 40 thus have no malfunction. In FIG. 6, the sensor signal 104 of the flow-through sensor 34 remains constant, even though the inlet valve 32 has been opened at the time instant t0. After expiration of the time interval Δt, in this example the sensor signal 102 of the sensor 40 changes at the time instant t2, wherefrom it can be concluded that fresh water has actually been supplied. Accordingly, there is a malfunction in the flow-through sensor 34.

FIG. 7 shows a further exemplary diagram of a sequence of a sensor signal 102 of a sensor 40 (see FIG. 3) of a household dishwasher 1, for example the household dishwasher 1 from FIG. 3. The sensor signal 102 changes along the time axis t as follows: The sensor signal 102 initially has a high level, which indicates that the sensor 40 is surrounded by washing liquor. At a time instant t0, for example the drain pump is activated in order to pump the washing liquor away. At a time instant t1, the washing liquor has for example been pumped away to such an extent that the sensor 40 is now surrounded by air, on account of which the level of the sensor signal 102 falls. At a time instant t2, the level of the sensor signal 102 rises again. Provided that no washing liquor has been supplied deliberately in the time interval Δt between t1 and t2, for example fresh water from the external water supply pipe 60 (see FIG. 2), it is possible to conclude from this rise that the drain check valve 36, which retains the pumped-off washing liquor in the outlet hose 70, is leaky and thus has a malfunction.

Figure 8:
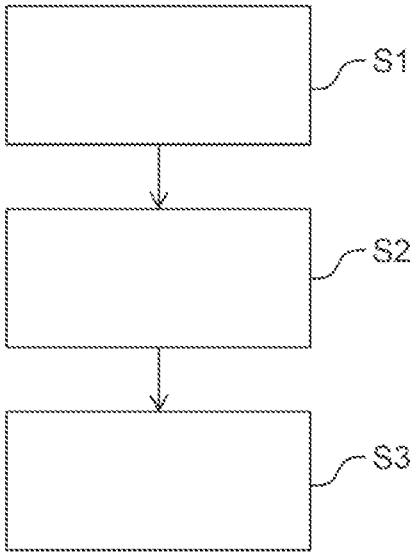
FIG. 8 shows a schematic block diagram of an exemplary embodiment of a method for operating a dishwasher.

FIG. 8 shows a schematic block diagram of an exemplary embodiment of a method for operating a dishwasher 1, for example one of the household dishwashers previously described with reference to FIGS. 1-4. In a first method step S1, a current operating state of the household dishwasher 1 is determined. This takes place in particular by way of the control apparatus 20 of the household dishwasher 1. In a second method step S2, a sensor signal 102 of a sensor 40 arranged in a pump sump 50 is detected and output to the control apparatus 20. In a third method step S3, a malfunction of a component 32-38 of a hydraulic assembly 30 of the household dishwasher 1 is determined as a function of the current operating state and of the sensor signal 102.

Although the present invention has been described with reference to exemplary embodiments, it can be modified in numerous different ways. In particular, all exemplary embodiments described can be combined with one another.

The invention claimed is:

1. A dishwasher, comprising:

a dishwasher interior for washing items to be washed with washing liquor;

a pump sump arranged at a lower end of the dishwasher interior for collecting soiled washing liquor;

an optical sensor arranged in the pump sump for outputting a sensor signal as a function of a presence of the soiled washing liquor at the optical sensor arranged in the pump sump;

a drain pump arranged in the pump sump for pumping the soiled washing liquor out of the pump sump into an outlet hose;

a drain check valve arranged between the drain pump and the outlet hose to retain the soiled washing liquor pumped into the outlet hose;

a hydraulic assembly; and a control apparatus configured to perform operations comprising:

executing a washing program selected from a number of washing programs;

activating the drain pump to pump the soiled washing liquor out of the pump sump into the outlet hose while an inlet valve is closed;

subsequent to activating the drain pump to pump the soiled washing liquor out of the pump sump into the outlet hose while the inlet valve is closed, receiving, from the optical sensor arranged in the pump sump, the sensor signal as the function of the presence of the soiled washing liquor at the optical sensor arranged in the pump sump; and detecting a malfunction of the drain check valve based on the receiving, from the optical sensor arranged in the pump sump, the sensor signal as the function of the presence of the soiled washing liquor at the optical sensor arranged in the pump sump, wherein the malfunction of the drain check valve comprises a failure of the drain check valve to retain the soiled washing liquor pumped into the outlet hose.

2. The dishwasher of claim 1, constructed in the form of a household dishwasher.

3. The dishwasher of claim 1, wherein the inlet valve is for connecting the dishwasher to an external water supply pipe for supplying fresh water, and wherein the control apparatus is further configured to perform operations comprising determining a malfunction of the inlet valve.

4. The dishwasher of claim 1, further comprising a flow-through sensor arranged between the inlet valve and the dishwasher interior to detect a fresh water volume supplied via the inlet valve, and wherein the control apparatus is further configured to perform operations comprising detecting a malfunction of the optical sensor, the flow-through sensor and/or the inlet valve as a function of the fresh water volume and of a sensor signal detected by the flow-through sensor.

5. The dishwasher of claim 1, wherein the dishwasher further comprises:

a liquor reservoir for temporary storage of washing liquor;

a valve arranged between the liquor reservoir and the dishwasher interior, said valve retaining in a closed state the temporarily stored washing liquor in the liquor reservoir and releasing in an open state the temporarily stored washing liquor into the dishwasher interior;

and wherein the control apparatus is further configured to perform operations comprising detecting a leakiness of the valve arranged between the liquor reservoir and the dishwasher interior.

6. The dishwasher of claim 5, wherein the control apparatus is configured to perform the operation of detecting the leakiness of the valve arranged between the liquor reservoir and the dishwasher interior after the liquor reservoir has been filled and before the temporarily stored washing liquor is released and/or fresh water is supplied into the dishwasher interior.

7. The dishwasher of claim 1, wherein the dishwasher further comprises:

a heat exchanger for receiving fresh water to support a drying process and for heating the received fresh water; and a valve arranged between the heat exchanger and the dishwasher interior, said valve retaining in a closed state the fresh water in the heat exchanger and releasing in an open state the fresh water into the dishwasher interior, and wherein the control apparatus is further configured to perform operations comprising detecting leakiness of the valve arranged between the heat exchanger and the dishwasher interior.

8. The dishwasher of claim 7, wherein the control apparatus is configured to perform the operation of detecting the leakiness of the valve arranged between the heat exchanger and the dishwasher interior after the heat exchanger has been filled and before the received fresh water is drained out and/or fresh water is supplied into the dishwasher interior.

9. The dishwasher of claim 1, wherein the optical sensor is arranged in the pump sump in such a way that the optical sensor is surrounded by washing liquor with a washing liquor volume of 0.4 liters.

10. The dishwasher of claim 1, wherein the optical sensor is arranged in the pump sump in such a way that the optical sensor is surrounded by washing liquor with a washing liquor volume of 0.3 liters.

11. The dishwasher of claim 1, wherein the optical sensor is arranged in the pump sump in such a way that the optical sensor is surrounded by washing liquor with a washing liquor volume below 0.3 liters in the pump sump.

12. The dishwasher of claim 1, further comprising a user interface designed to output the malfunction of the drain check valve.

13. The dishwasher of claim 12, further comprising a memory unit designed to store the malfunction of the drain check valve, said user interface outputting the malfunction of the drain check valve stored in the memory unit.

14. A method for operating a dishwasher, said method comprising:

activating a drain pump to pump soiled washing liquor out of a pump sump into an outlet hose while an inlet valve is closed, wherein the pump sump is arranged at a lower end of a dishwasher interior for collecting washing liquor used for washing items to be washed in the dishwasher interior, wherein the drain pump is arranged in the pump sump, and wherein a drain check valve is arranged between the drain pump and the outlet hose to retain the soiled washing liquor pumped into the outlet hose;

subsequent to activating the drain pump to pump the soiled washing liquor out of the pump sump into the outlet hose while the inlet valve is closed, receiving, from an optical sensor arranged in the pump sump, a sensor signal as a function of a presence of the soiled washing liquor at the optical sensor arranged in the pump sump;

determining a malfunction of the drain check valve based on the receiving, from the optical sensor arranged in the pump sump, the sensor signal as the function of the presence of the soiled washing liquor at the optical sensor arranged in the pump sump, wherein the malfunction of the drain check valve comprises a failure of the drain check valve to retain the soiled washing liquor pumped into the outlet hose.

15. The method of claim 14, wherein the method is for operating a household dishwasher.

16. A computer program product for operating a dishwasher, comprising a computer program embodied in a non-transitory computer readable medium, wherein the computer program, when loaded into a computer and executed by the computer, causes the computer to execute the steps of:

activating a drain pump to pump soiled washing liquor out of a pump sump into an outlet hose while an inlet valve is closed, wherein the pump sump is arranged at a lower end of a dishwasher interior for collecting washing liquor used for washing items to be washed in the dishwasher interior, wherein the drain pump is arranged in the pump sump, and wherein a drain check valve is arranged between the drain pump and the outlet hose to retain the soiled washing liquor pumped into the outlet hose;

subsequent to activating the drain pump to pump the soiled washing liquor out of the pump sump into the outlet hose while the inlet valve is closed, receiving, from an optical sensor arranged in the pump sump, a sensor signal as a function of a presence of the soiled washing liquor at the optical sensor arranged in the pump sump;

and determining a malfunction of the drain check valve based on the receiving, from the optical sensor arranged in the pump sump, the sensor signal as the function of the presence of the soiled washing liquor at the optical sensor arranged in the pump sump, wherein the malfunction of the drain check valve comprises a failure of the drain check valve to retain the soiled washing liquor pumped into the outlet hose.

* * * * *